US005381720A

United States Patent [19]

Roheim

[11] Patent Number: 5,381,720

[45] Date of Patent: Jan. 17, 1995

[54] DEVICE FOR MORTARS

[75] Inventor: Karl-Axel Roheim, Nynäshamn, Sweden

[73] Assignee: AB Food Mark Production, Haninge, Sweden

[21] Appl. No.: 87,745

[22] PCT Filed: Jan. 10, 1992

[86] PCT No.: PCT/SE92/00012

§ 371 Date: Jul. 12, 1993

§ 102(e) Date: Jul. 12, 1993

[87] PCT Pub. No.: WO92/12394

PCT Pub. Date: Jul. 23, 1992

[30] Foreign Application Priority Data

Jan. 11, 1991 [SE] Sweden ..... 9100101

[51] Int. Cl.[6] ..... F41A 33/00; F41F 1/00

[52] U.S. Cl. ..... 89/1.35; 89/1.1; 89/29; 102/445; 102/498

[58] Field of Search ..... 102/445, 498, 529; 89/29, 1.35, 1.1

[56] References Cited

U.S. PATENT DOCUMENTS 1,399,243 12/1921 Bergman ..... 89/1.35
2,451,524 10/1948 Walker ..... 89/1.35
2,955,585 10/1960 Friedland et al. ..... 89/29
3,500,715 3/1970 Batou ..... 89/1.1

FOREIGN PATENT DOCUMENTS 125522 9/1972 Norway .
WO90/12268 10/1890 WIPO .

*Primary Examiner*—David Brown
*Attorney, Agent, or Firm*—Jacobson, Price, Holman & Stern

[57] ABSTRACT

An apparatus for mortars for simulating the loading and firing of live ammunition by using a dummy shell. The apparatus includes a mortar, a spacer piece, and a dummy shell. The spacer piece and dummy shell are inserted into the mortar barrel. The length of the spacer piece and dummy shell are such that the top of the dummy shell projects a distance past the muzzle of the barrel. The spacer piece includes a firing pin mechanism including a firing pin and a triggering mechanism. A triggering pin projects from a top plate of the spacer piece and is movable from a projected position into a retracted position for triggering. The firing pin mechanism includes spring biassed rods which project out from the top plate of the spacer piece and are urged inwards by the dummy shell. The firing pin mechanism is biassed by a latch which is releaseable by an electromagnet.

8 Claims, 2 Drawing Sheets

DEVICE FOR MORTARS

The present invention relates to apparatus for mortars intended to simulate loading and firing with live ammunition by using a dummy inserted in the barrel of the mortar via its muzzle.

A mortar is a smooth bore muzzle loading weapon, where a shell is dropped into the bore. When the shell has come to the bottom of the bore, firing takes place either by the impact of the shell against a fixed firing pin or by the aid of a special firing mechanism.

The object of the present invention is now to cheapen mortar shelling training. Personnel will thus simulate loading and firing while using a dummy of the same appearance and weight as a genuine shell. Firing drill shall exactly correspond to the actual routine used with live ammunition in field scale shelling.

The object of the invention is achieved by the apparatus having been given the distinguishing features disclosed in the accompanying claims.

An embodiment of the invention will now be described, with reference to the accompanying drawing figures, variations of the embodiment also being apparent therefrom.

FIG. 1 illustrates in principle a longitudinal section through an inventive apparatus, while

Figure 1:
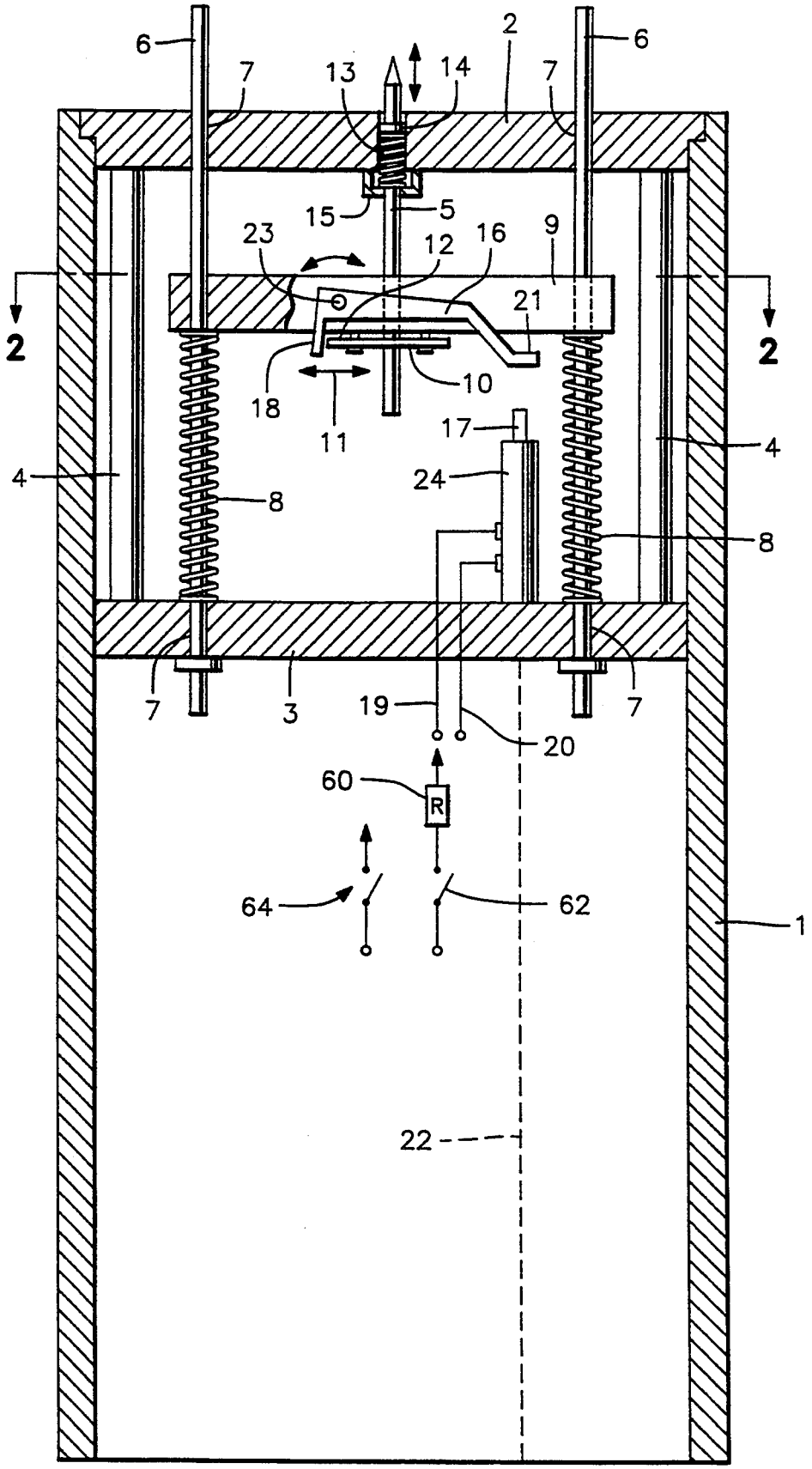
Figure 2:
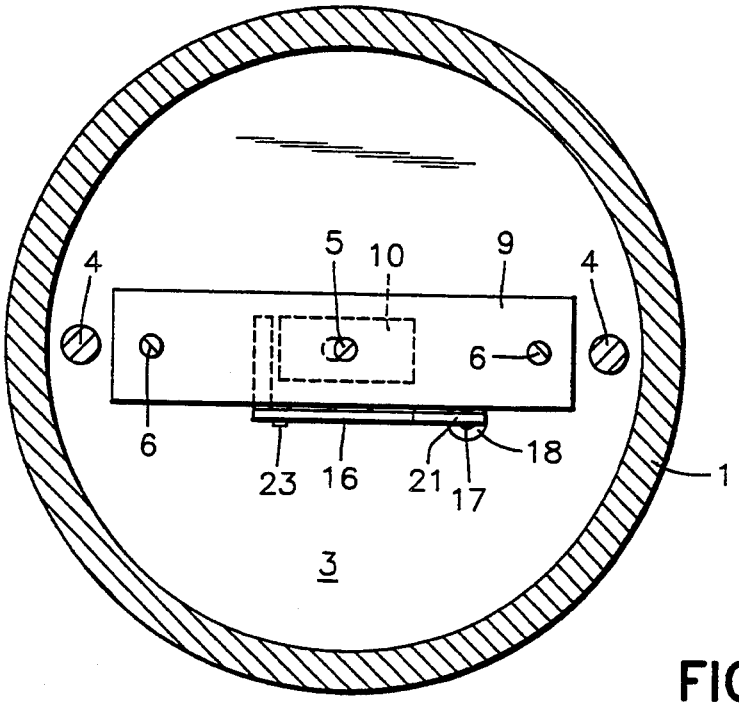
FIG. 2 is a section along the line II—II in FIG. 1.
Figure 3:
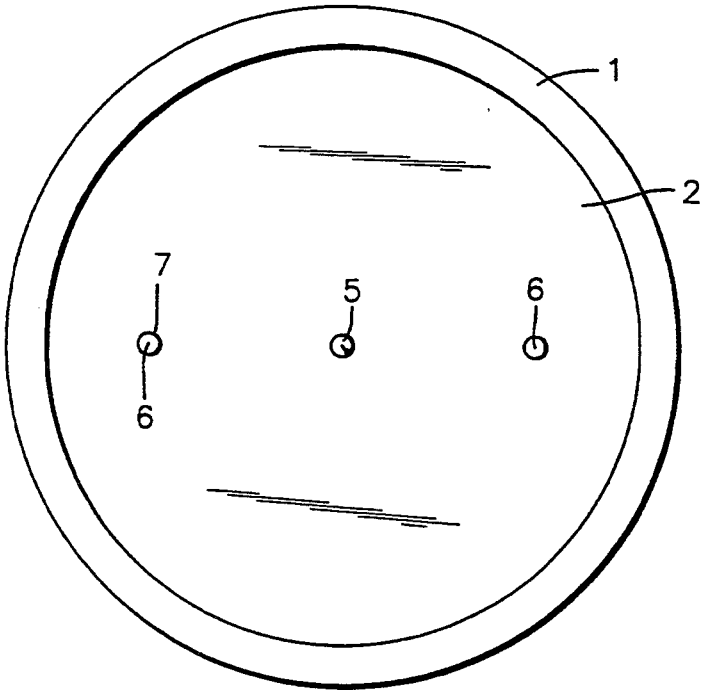
FIG. 3 is a plan as seen from above.
Figure 4:
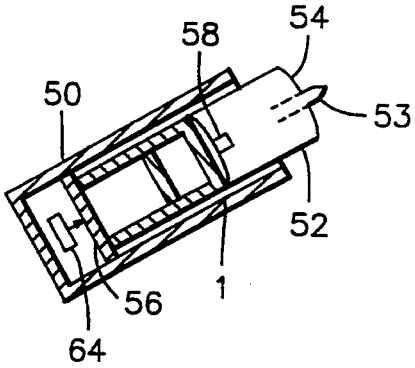
FIG. 4 is a schematic of a mortar, spacer piece, and dummy shell.

A conventional mortar includes a barrel 50, which can be of 8 or 12 cm caliber. A dummy 52 of the same appearance and weight as a genuine shell is used in conjunction with the inventive apparatus.

The dummy 52 is provided with a so-called practice projectile 53, which can leave it, in this way simulating a genuine projectile. With the aid of the invention the dummy can be placed in the barrel so that its tip 54 projects a distance past the barrel muzzle. This means that when the practice projectile has been fired the dummy may be removed from the barrel, i.e. the dummy is not discharged but only the practice projectile. A spacer piece 1 in the form of a tube is provided to achieve raised height of the dummy in the barrel. The lower end of the piece 1 rests on the supporting surface 56 provided in the barrel for a genuine shell inserted in it. The length of the piece is defined such that when the dummy is used its tip 54 projects a distance from the muzzle of the barrel. At its lower end, i.e. the end first inserted in the barrel, the dummy has an ignition cap 58, which must be struck to fire the shell. A firing pin mechanism is required for this purpose, and in this case is disposed in the upper end of the spacer piece. It will be seen from FIG. 1 that the mechanism is arranged between upper 2 and lower 3 plates, which are united by struts 4. The configuration of struts and plates is disposed in the tube 1 such that the upper 2 is flush with the upper edge of the tube.

The mechanism itself includes a firing pin 5, which can move reciprocatingly in the plate 2. Upward movement of the pin is taken to be sufficiently violent that a cap struck by the pin is detonated. The firing pin is set as the dummy moves down the barrel after insertion at its muzzle, and two push rods are provided for this purpose. They are mounted in guides 7 in the plates 2 and 3 such as to extend through them, and are urged to move downwards by the weight of the dummy against the bias of their individual springs 8. These springs bear against the upper side of plate 3 and the underside of a yoke 9 extending between the push rods 6 and rigidly connected to them. The rods 6 will thus be urged downwards by the weight of the dummy, and will move through the plates 2 and 3 until the underside of the dummy engages the upper side of plate 2. The firing pin 5 accompanies this movement of the yoke 9, but can move freely through a guide in it. However, a washer 10, through which the pin passes, is disposed on the underside of the yoke, and is biased by a spring 12 to move to the left in the FIG. The firing pin 5 is provided with a recess (unillustrated) into which an edge of the hole in the washer is urged by the spring 12. The possible movement of the washer is depicted by the double arrows 11. Accordingly, when the yoke 9 is urged downwards by the push rods 6 taking the weight of the dummy, the washer 10, due to its mating with the pin 5, will cause the pin to move downwards against the bias of a spring 13 disposed in the upper plate 2. At its upper end the spring 13 bears against a stop 14 on the pin, while its lower end bears against fixed annular stop on the underside of the upper plate 2. The spring 13 is thus compressed as the pin is moved downwards, and the pin is kept in its downward position as long as the washer 10 engages with it.

As will be seen, one end of the spring 12 coacts with the washer 10, while its other end engages a bell crank-like member 16, pivotably mounted about a centre 23 on one side of the yoke 9. When the member is swung anticlockwise its dependent portion 18 will urge the washer 10 to the right, thereby releasing the edge of the hole in the washer from its engagement with the unillustrated recess in the pin 5. The pin is now free to move forcefully upwards under the bias of the spring 13, to strike against the firing cap 58 on the dummy resting on top of the plate 2. The cap ignites such as an impelling charge, for driving a so-called drill projectile 53 placed in the dummy. The latter remains in the barrel 50, resting against the plate 2. The firing pin is set by lifting up the dummy so that the yoke 9 is raised by the springs 8, allowing the edge of the hole in the washer 10 once again to snap into the unillustrated recess in the pin 5 as the spring 12 urges the washer to the left, this movement being indicated by the left arrow of the double arrows 11. The member 16 is configured such that it is always kept pivoted clockwise as far as possible, as long as the right hand end of the member is not urged upwards.

An electromagnetically driven knocker pin 17 is utilised for actuating the member 16. The pin is arranged in an electromagnet 24. When the magnetising circuit is activated by supplying current to the connections 19 and 20 the knocker pin is thrust upwards. Thus, when the yoke 9 has been urged downwards by the push rods 6, the right hand end of the member 16 at its striking plate portion 21 will be situated just above the knocker pin 17. On activation of the electromagnet 24, the knocker pin is thrust upwards to strike against the portion 21 and move it upwards, thus causing the member 16 to pivot anticlockwise. As previously mentioned, the washer is then caused to move to the right, which releases the latching of the washer to the firing pin 5, and this in turn is thrust rapidly upwards to activate the firing cap on the dummy, as already described.

When a mortar is used in active service, there is a given delay before the live shell reaches the bottom of the standard barrel 50 and is fired. This delay must be simulated in the invention, although it will be understood that a shorter time is taken when the dummy is dropped into the barrel, since the spacer piece raises the level of the bottom position of the dummy. The difference in time must therefore be compensated, which is achieved by putting a relay 60 in circuit with the electromagnetic device. Triggering the knocker pin is delayed by the relay for a given period of time, e.g. 1 sec. such as to equalise the times taken for the dummy and the live shell to fall to their respective bottom positions. The function of the electromagnetic device may be such that when the push rods 6 are urged to their bottom positions by the dummy a contactor closes a circuit so that current is supplied to the electromagnetic device 18, which would mean that the knocker pin 17 is immediately thrust upwards when the push rods reach their bottom position. However, the previously mentioned delaying relay is in circuit between a contactor 62 and the electromagnetic device, thus enabling provision of the desired time delay of the current to the device.

In the case where firing is by direct action of the operator, the relay is quite simply bypassed, and a switch 64 (shown schematically) that can be actuated by the operator is put in circuit. This means that when the dummy is in its lowest position the relay does not pass any current to the electromagnetic device 18, which is then activated by the hand operated switch. Accordingly, the operator activates the dummy by closing the switch at an optional time, for permitting supply of current to the electromagnetic device 18, which causes the knocker pin 17 to pivot the member 16 anticlockwise for releasing the striking pin 5. It will be noted that two different methods of firing the dummy have now been described.

An alternative embodiment of the invention is also illustrated in FIG. 1. A dashed line 22 illustrates a replacement for the knocker pin 17 and electromagnetic device 18. This replacement comprises a rod extending from the imagined upper end of the pin 17 and downwards through the entire spacer piece 1, for being connected to the normal triggering mechanism, or the firing pin mechanism 64 at the bottom of the barrel. The rod 22 actuates or transmits the action of this firing pin mechanism to the member 16.

Further embodiments of the invention may be envisaged within the scope of the inventive concept, one such embodiment quite simply comprising a very powerful electromagnetic actuating means that can act directly on the firing pin. Such a means then replaces the device 18, knocking pin 17, member 16, washer 10, spring 13 and associated details 14 and 15. In its most simple form, the firing pin may be fixed at the upper end of the spacer piece, the impact of the dummy against the firing pin when the dummy has moved down the barrel enabling activation of the firing cap on the dummy.

I claim:

1. An apparatus for mortars for simulating loading and firing with live ammunition by using a dummy shell which is muzzle loaded into the barrel of an ordinary mortar, the apparatus comprising a spacer piece removably insertable in said barrel, said spacer piece having a top plate at one end and a lower end, said lower end resting adjacent the barrel bottom, said spacer piece having a length less than the length of said barrel and wherein the combined length of said spacer piece and said dummy shell is greater than the length of said barrel so that the top of said dummy shell projects past the muzzle of said barrel when the dummy shell is inserted in said barrel and rests upon the top plate of said spacer piece, said spacer piece comprising a firing pin mechanism including a firing pin extending through the top plate and which has a projected position and a retracted position, said firing pin mechanism including a triggering means for triggering the firing pin to hit an ignition cap in the end of said dummy shell.

2. The apparatus as claimed in claim 1, wherein the spacer piece is in the form of a tube having a diameter less than the diameter of the mortar barrel.

3. The apparatus as claimed in claim 1, wherein said triggering means includes an electromagnet.

4. The apparatus as claimed in claim 1, wherein said firing pin mechanism includes means engaging with said dummy shell to draw the firing pin to its retracted position when said dummy shell rests against the top plate of said spacer piece.

5. The apparatus as claimed in claim 4 wherein said triggering means comprises a spring biassed latch means for releasably retaining the firing pin in its retracted position, and an electromagnetic release means for releasing the latch means to trigger the firing pin.

6. The apparatus as claimed in claim 5 wherein said electromagnetic release means includes a delay means for delaying the release of the latch means.

7. The apparatus as claimed in claim 5, wherein said means engaging with said dummy shell comprises one or more spring biassed rods which project out from the top plate of said spacer piece and which are engaged by said dummy shell to urge the rods into the spacer piece by the weight of the dummy shell to cause the firing pin to move into its retracted position.

8. The apparatus as claimed in claim 5, wherein said spring biassed latch means is connected by a linkage in the spacer piece to a mortar firing pin mechanism, said mortar firing pin mechanism situated within said mortar barrel.

* * * * *